US008607460B1

(12) United States Patent
Lerch et al.

(10) Patent No.: US 8,607,460 B1
(45) Date of Patent: Dec. 17, 2013

(54) SINGLE SPRING ARM ASSISTED KNIFE

(76) Inventors: Matthew J. Lerch, Sussex, WI (US); Kenneth A. Steigerwalt, Orangeville, PA (US)

( * ) Notice: Subject to any disclaimer, the term of this patent is extended or adjusted under 35 U.S.C. 154(b) by 254 days.

(21) Appl. No.: 13/053,483

(22) Filed: Mar. 22, 2011

Related U.S. Application Data

(60) Provisional application No. 61/322,462, filed on Apr. 9, 2010.

(51) Int. Cl.
*B26B 3/06* (2006.01)

(52) U.S. Cl.
USPC ..... 30/155; 30/159; 30/160

(58) Field of Classification Search
USPC ..... 30/151–161
See application file for complete search history.

(56) References Cited

U.S. PATENT DOCUMENTS 6,308,420 B1 * 10/2001 Moser ..... 30/161
6,651,344 B2 * 11/2003 Cheng ..... 30/159
6,732,436 B2 * 5/2004 Moizis ..... 30/155
7,243,430 B1 * 7/2007 Lerch ..... 30/160
7,293,360 B2 11/2007 Steigerwalt et al.
7,562,454 B2 7/2009 Steigerwalt et al.
8,042,276 B2 * 10/2011 Lerch et al. ..... 30/155
2002/0104220 A1 * 8/2002 Marfione ..... 30/160
2006/0059694 A1 * 3/2006 Carter ..... 30/159
2006/0248727 A1 * 11/2006 Kain ..... 30/158
2010/0212163 A1 * 8/2010 Liu ..... 30/159

* cited by examiner

*Primary Examiner* — Omar Flores Sanchez
(74) *Attorney, Agent, or Firm* — Donald J. Ersler

(57) ABSTRACT

A single spring arm assisted knife includes a base frame and a blade. A spring arm is formed as an integral portion of the base frame. A frame lock is also formed as an integral portion of the base frame. One end of the blade is pivotally retained by one end of the base frame at a blade pivot point. A thumb stud is secured to the blade. A stop pin is pressed into the base frame, adjacent the blade pivot point. A roller is pivotally retained on one end of the spring arm. An assist cam surface is formed on the one end of the blade to receive the roller. A second embodiment of the single spring arm assisted knife includes a spring arm which is not an integral portion of the base frame, but is attached to the base frame.

12 Claims, 3 Drawing Sheets

SINGLE SPRING ARM ASSISTED KNIFE

CROSS-REFERENCES TO RELATED APPLICATIONS

This is a nonprovisional application taking priority from provisional application No. 61/322,462, filed on Apr. 9, 2010.

BACKGROUND OF THE INVENTION

1. Field of the Invention

The present invention relates generally to assisted knives and more specifically to a single spring arm assisted knife, which only requires a single spring arm to assist in opening the knife.

2. Discussion of the Prior Art

U.S. Pat. No. 7,293,360 to Steigerwalt et al. discloses a knife blade opening mechanism. The Steigerwalt et al. '360 patent includes an assist mechanism that functions to drive the blade from a closed to an open position. U.S. Pat. No. 7,562,454 to Steigerwalt et al. discloses a knife blade opening mechanism. The Steigerwalt et al. '454 patent includes an opening assist mechanism that functions to drive the blade from a closed to an open position.

Accordingly, there is a clearly felt need in the art for a single spring arm assisted knife, which only requires a single spring arm to assist in driving the blade from a closed position to an open position.

SUMMARY OF THE INVENTION

The present invention provides a single spring arm assisted knife, which only requires a single spring arm to assist in opening the knife. The single spring arm assisted knife includes a base frame and a blade. The base frame is fabricated from a material having memory or resilience. A spring arm is formed as an integral portion of the base frame by laser cutting or the like. A frame lock is also formed as an integral portion of the base frame. An end of the frame lock is bent to engage one end of the blade. A blade pivot bushing is pressed into one end of the base frame. A pivot hole is formed through the one end of the blade, which is sized to receive the blade pivot bushing. A blade screw is threaded into the blade pivot bushing to pivotally retain the blade on the base frame. A thumb stud is secured to the blade at substantially the one end thereof. A stop pin is pressed into the base frame, adjacent the blade pivot bushing. A roller is pivotally retained on one end of the spring arm by pressing a roller pivot pin into the one end of the spring arm. An assist cam surface is formed on the one end of the blade to receive the roller such that opening assistance of the blade does not occur, until the blade is opened at least 20 degrees relative to the base frame.

A second embodiment of the single spring arm assisted knife includes a base frame, a blade and a spring arm. A spring retention pocket is formed in the base frame to receive and retain the spring arm. The spring arm is fabricated from a material having memory or resilience. The one end of the spring arm is attached to the base frame with at least one fastener. A frame lock is preferably formed as an integral portion of the base frame. An end of the frame lock is bent to engage one end of the blade. A blade pivot bushing is pressed into one end of the base frame. A pivot hole is formed through the one end of the blade, which is sized to receive the blade pivot bushing. A blade screw is threaded into the blade pivot bushing to pivotally retain the blade on the base frame. A thumb stud is secured to the blade at substantially the one end thereof. A stop pin is retained in a stop hole in the base frame, adjacent the blade pivot bushing with a fastener. A roller is pivotally retained on the other end of the spring arm by pressing a roller pivot pin into the other end of the spring arm. An assist cam surface is formed on the one end of the blade to receive the roller such that opening assistance of the blade does not occur, until the blade is opened at least 20 degrees relative to the base frame.

Accordingly, it is an object of the present invention to provide a single spring arm assisted knife, which only requires a single spring arm to assist in driving the blade from a closed position to an open position.

These and additional objects, advantages, features and benefits of the present invention will become apparent from the following specification.

DETAILED DESCRIPTION OF THE PREFERRED EMBODIMENTS

Figure 1:
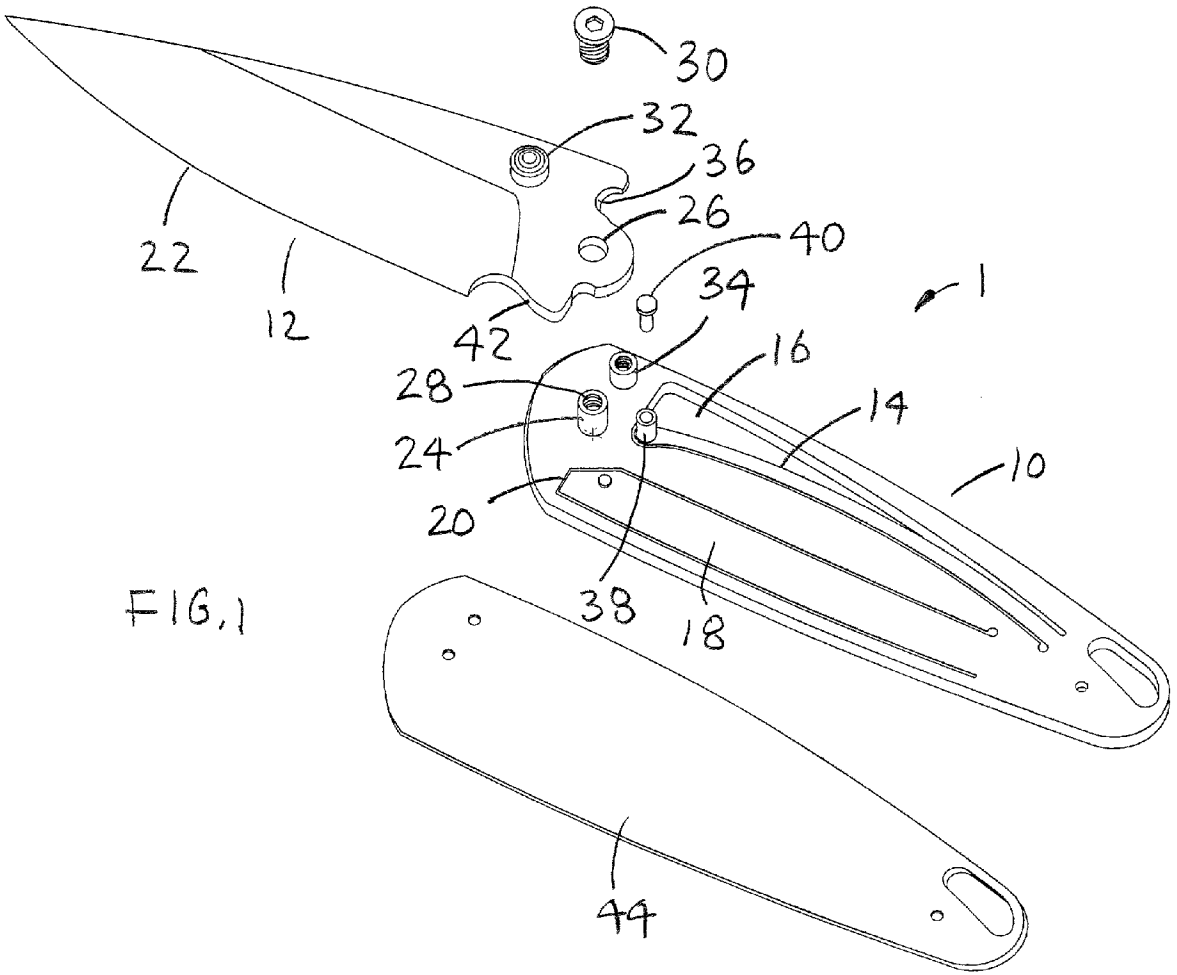
FIG. 1 is an exploded perspective view of a single spring arm assisted knife in accordance with the present invention.
Figure 2:
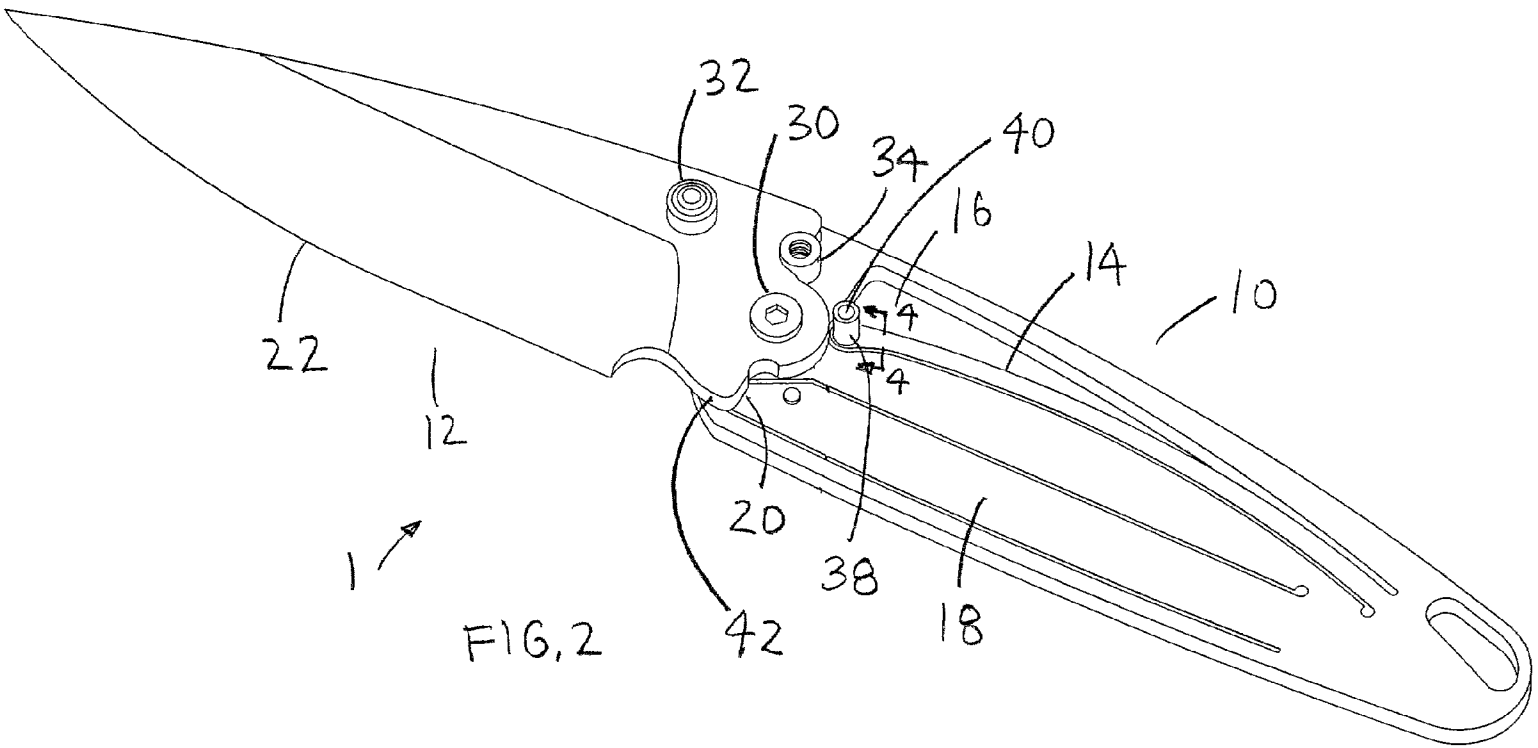
FIG. 2 is a perspective view of a single spring arm assisted knife in an open position in accordance with the present invention.

With reference now to the drawings, and particularly to FIG. 1, there is shown a perspective view of a single spring arm assisted knife 1. With reference to FIG. 2, the single spring arm assisted knife 1 includes a base frame 10 and a blade 12. The base frame 10 is fabricated from a material having memory or resilience. A spring arm 14 is formed as an integral portion of the base frame 10 by laser cutting or any other suitable method. A swing opening 16 cavity is formed above the spring arm 14 to provide clearance for the cantilever motion of spring arm 14, when the blade 10 is being placed in an open position. A frame lock 18 is also formed as an integral portion of the base frame 10 with laser cutting or any other suitable method. An end 20 of the frame lock 18 is bent to engage one end of the blade 12. A cutting surface 22 is formed on at least one edge of the blade 12.

A blade pivot bushing 24 is pressed into one end of the base frame 10. A pivot hole 26 is formed through the one end of the blade 10, which is sized to receive the blade pivot bushing 24. The blade pivot bushing 24 includes a threaded tap 28 formed through a length thereof. A blade screw 30 is threaded into the threaded tap 28 to pivotally retain the blade 12 on the base frame 10. A thumb stud 32 is secured to the blade 10 at substantially the one end thereof with any suitable method. A stop pin 34 is pressed into the base frame 10, adjacent the blade pivot bushing 28. A stop slot 36 is preferably formed in an end of the blade 12 to receive the stop pin 34.

A roller 38 is pivotally retained on one end of the spring arm 14 by pressing a roller pivot pin 40 into the one end of the spring arm 14. An assist cam surface 42 is formed on an edge of the one end of the blade 12 for contact with the roller 38, such that opening assistance of the blade 12 does not occur, until the blade 12 is opened at least 20 degrees relative to the base frame 10. The spring arm 14 applies force against cam surface 42 to force the blade into an open position, after the at least 20 degrees. An optional back frame cover 44 may be attached to a back side of the base frame 10.

Figures 3, 4:
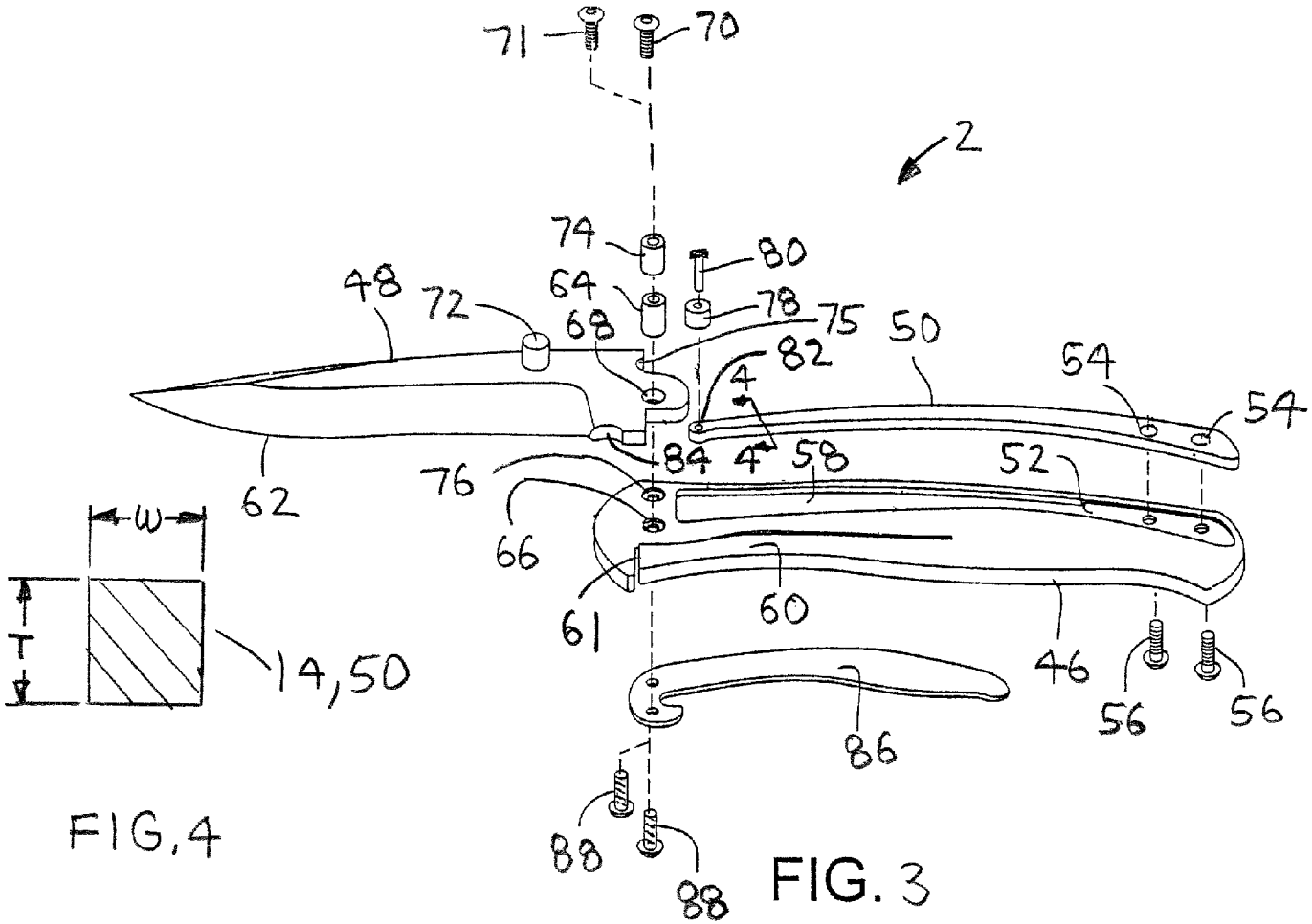
FIG. 3 is an exploded perspective view of a second embodiment of a single spring arm assisted knife in accordance with the present invention.
FIG. 4 is a cross-sectional view of a spring arm from the first or second embodiments of a single spring arm assisted knife in accordance with the present invention.

With reference to FIG. 3, a second embodiment of the single spring arm assisted knife 2 includes a base frame 46, a blade 48 and a spring arm 50. A spring retention pocket 52 formed in one end of the base frame 46 to retain one end of the spring arm 50. At least one threaded hole 54 is formed in the one end of the spring arm 50 to threadably receive at least one arm fastener 56. The at least one arm fastener 56 retains the spring arm 50 in the spring retention pocket 52. A spring clearance pocket 58 extends from the spring retention pocket 52. The spring clearance pocket 58 provides clearance for the cantilever motion of the spring arm 50. The spring arm 50 is fabricated from a material having memory or resilience. A frame lock 60 is preferably formed as an integral portion of the base frame 46 with laser cutting or the like. An end 61 of the frame lock 60 is bent to engage one end of the blade 48. A cutting surface 62 is formed on at least one edge of the blade 48.

A blade pivot bushing 64 is pressed into a bushing hole 66 in one end of the base frame 46. A pivot hole 68 is formed through the one end of the blade 48, which is sized to receive the blade pivot bushing 64. A blade screw 70 is threaded into the blade pivot bushing 64 to pivotally retain the blade 48 on the base frame 46. A thumb stud 72 is secured to the blade at substantially the one end thereof with any suitable method. A stop pin 74 is retained in a stop hole 76 in the base frame, adjacent the blade pivot bushing 64 with a fastener 71. A stop slot 75 is preferably formed in an end of the blade 12 to receive the stop pin 74.

A roller 78 is pivotally retained on the other end of the spring arm 50 by pressing a roller pivot pin 80 into a roller hole 82 in the other end of the spring arm 50. An assist cam surface 84 is formed on the one end of the blade 48 to receive the roller 78 such that opening assistance of the blade 48 does not occur, until the blade 48 is opened at least 20 degrees relative to the base frame 46. The spring arm 50 applies force against cam surface 84 to force the blade 48 into an open position, after the at least 20 degrees. An optional pocket clip 86 may be attached to a back side of the base frame 46 with at least two fasteners 88.

With reference to FIG. 4, a cross section of the smallest portion of the spring arm 14, 50 is shown. The thickness "t" of the spring arm 14, 50 is equal to or greater than the greatest width "w" of the spring arm 14, 50. Otherwise the spring arm 14, 50 will twist, when exerting force through the roller 38, 78 against the assist cam surface 42, 84 to open the blade 12, 48.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

We claim:

1. A single spring arm assisted knife comprising:

a base frame includes a first end;

a blade includes a first end pivotally retained on said first end of said base frame, a cam assist surface is formed on an edge of said first end of said blade;

a spring arm includes a first end and a second end, said second end of said spring arm is retained by said base frame, a thickness of a cross section of said spring arm is equal to or greater than the greatest width of said spring arm over substantially all of a length of said spring arm, wherein said blade is partially opened to receive opening assistance from said spring arm; and a roller is pivotally retained on said first end of said spring arm, said roller contacting said cam assist surface, wherein said roller is pivotally supported on only one end by said spring arm, said spring arm is offset relative to said blade.

2. The single spring arm assisted knife of claim 1, further comprising:

a frame lock is formed as an integral portion of said base frame, an end of said frame lock is bent to contact said first end of said blade.

3. The single spring arm assisted knife of claim 1, further comprising:

a back frame cover is attached to a back side of said base frame.

4. The single spring arm assisted knife of claim 1, further comprising:

a thumb stud is attached to substantially a first end of said blade for opening thereof.

5. A single spring arm assisted knife comprising:

a base frame includes a first end, said base frame is fabricated from a material having at least one of memory and resilience;

a blade includes a first end pivotally retained on said first end of said base frame, a cam assist surface is formed on an edge of said first end of said blade;

a spring arm includes a first end and a second end, said second end of said spring arm is an integral portion of said base frame, a thickness of a cross section of said spring arm is equal to or greater than the greatest width of said spring arm over substantially all of a length of said spring arm, wherein said blade is partially opened to receive opening assistance from said spring arm; and a roller is pivotally retained on said first end of said spring arm, said roller contacting said cam assist surface, wherein said roller is pivotally supported on only one end by said spring arm, said spring arm is offset relative to said blade.

6. The single spring arm assisted knife of claim 5, further comprising:

a frame lock is formed as an integral portion of said base frame, an end of said frame lock is bent to contact said first end of said blade.

7. The single spring arm assisted knife of claim 5, further comprising:

a back frame cover is attached to a back side of said base frame.

8. The single spring arm assisted knife of claim 5, further comprising:

a thumb stud is attached to substantially a first end of said blade for opening thereof.

9. A single spring arm assisted knife comprising:

a base frame includes a first end;

a blade includes a first end pivotally retained on said first end of said base frame, a cam assist surface is formed on an edge of said first end of said blade;

a spring arm includes a first end and a second end, said second end of said spring arm is secured to said base frame, a thickness of a cross section of said spring arm is equal to or greater than the greatest width of said spring arm over substantially all of a length of said spring arm, wherein said blade is partially opened to receive opening assistance from said spring arm; and a roller is pivotally retained on said first end of said spring arm, said roller contacting said cam assist surface, wherein said roller is pivotally supported on only one end by said spring arm, said spring arm is offset relative to said blade.

10. The single spring arm assisted knife of claim 9, further comprising:

a frame lock is formed as an integral portion of said base frame, an end of said frame lock is bent to contact said first end of said blade.

11. The single spring arm assisted knife of claim 9, further comprising:

a back frame cover is attached to a back side of said base frame.

12. The single spring arm assisted knife of claim 9, further comprising:

a thumb stud is attached to substantially a first end of said blade for opening thereof.

* * * * *